United States Patent [19]

Branson

[11] 3,982,352

[45] Sept. 28, 1976

[54] KNOCK DOWN CONVERTIBLE TOY

[76] Inventor: J. Howard Branson, 127 S. Atlantic Ave., Haddonfield, N.J. 08033

[22] Filed: Apr. 7, 1975

[21] Appl. No.: 565,411

[52] U.S. Cl. ..... 46/17

[51] Int. Cl.[2] ..... A63H 33/06

[58] Field of Search ..... 46/15–17; 5/99 B, 105; 297/440

[56] References Cited

UNITED STATES PATENTS

| | | | |
|---|---|---|---|
| 1,396,039 | 11/1921 | Halm | 46/15 |
| 2,510,884 | 6/1950 | Greene | 46/17 |
| 2,619,768 | 12/1952 | Tomchin | 46/17 |

*Primary Examiner*—Louis G. Mancene
*Assistant Examiner*—Robert F. Cutting
*Attorney, Agent, or Firm*—Charles F. Duffield

[57] ABSTRACT

A knockdown toy is disclosed which may be assembled in numerous different configurations and includes a basic frame formed of a rectangular intermediate panel and opposed end panels secured thereto. Two side panels and two rocker panels are provided and may be respectively positioned along the long edges of the intermediate panel and upper or lower edges of the end panels to create different toy configurations as desired. Also provided are a plurality of elongate rods and two axle and wheel assemblies which permit the creation of canopy and wagon configurations respectively.

3 Claims, 7 Drawing Figures

KNOCK DOWN CONVERTIBLE TOY

BACKGROUND OF INVENTION

The present invention is concerned with toys and, particularly, toys of the type which may be disassembled and reassembled into different configurations.

As a general rule, toys such as doll beds, sofas and wagons have been constructed as a single or unitary item and serve only a single function. It is accordingly necessary for a child to have one of each of the different types of toys, i.e. doll beds and wagons, in order to have the range of toys which children usually desire. Additionally, children very quickly lose interest in toys which provide only a single function or use inasmuch as they have limited utility and present no challenge to the child's imagination or ingenuity.

OBJECT AND SUMMARY OF INVENTION

It is the object of the present invention to provide a knockdown type of toy which utilizes a plurality of basic components which are formed to complement each other and are capable of assembly into different configurations and styles of toys such as doll beds, sofas and wagons.

The present invention carries out the foregoing object by the utilization of a basic frame formed of a rectangular intermediate panel to which two end panels are secured. Two side panels are provided which may be detachably secured to the long edges of the intermediate panel to form such items as the sides of a cradle, a crib, rocking chair or back of a sofa. Additionally, two rocker panels are provided which may be detachably engaged with the lower edges of the end panels to provide rockers for the toy in the configuration of a cradle.

The rocker panels may also be assembled to the upper edges of the end panels. A plurality of rod like members are provided and cooperate with apertures within the rockers to provide a canopy like effect when the rods are assembled to the rocker panels. Lastly, two axle-wheel assemblies are provided which may be assembled into cooperation with the lower edges of the end panels to form a wagon.

DESCRIPTION OF DRAWINGS

FIG. 2 - basic bed;
FIG. 3 - bed with canopy;
FIG. 4 - sofa;
FIG. 5 - rocking safe;
FIG. 6 - bed with sides;
FIG. 7 - cradle with sides.

DETAILED DESCRIPTION OF INVENTION

Figure 1:
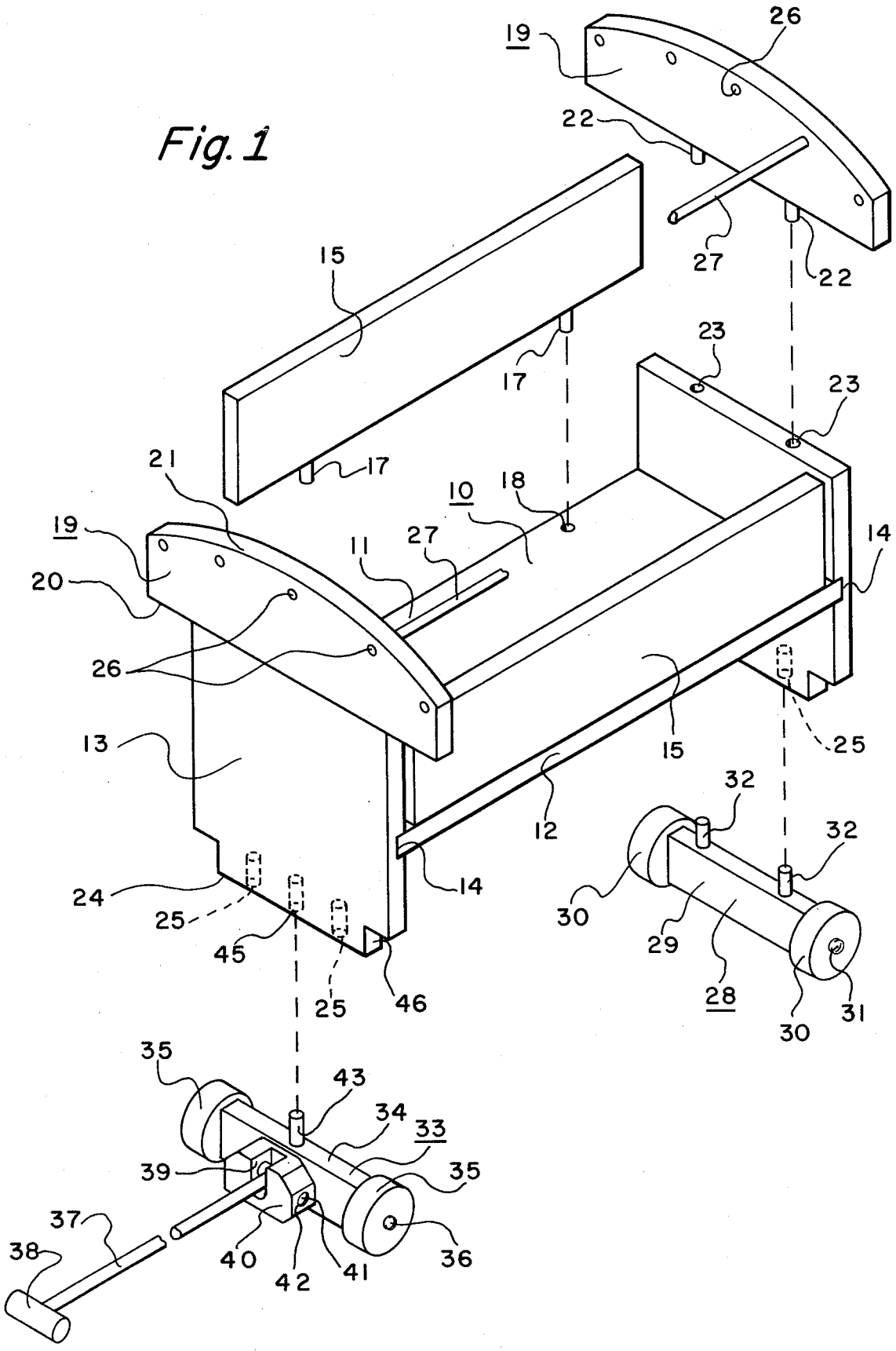
FIG. 1 is a perspective partially exploded view of the knockdown toy of the present invention.

FIg. 1 of the drawings shows all of the components involved in the knockdown toy in an exploded view which, when assembled, represents a covered wagon. FIG. 1 will be utilized for a detailed description of each of the respective components of the knockdown toy since this configuration utilizes all of the different components involved. Thereafter, the remaining FIGS. 2–7 will be briefly discussed which are illustrative of the various configurations of toys which may be made using selected ones of the total number of components shown in FIG. 1 and rearranged into different combinations.

The toy includes a basic frame member 10 which includes a flat horizontally disposed rectangular intermediate panel 11. The intermediate panel is rectangular and includes two free long sides 12. The other two opposed shorter sides or ends of the panel 11 terminate into vertically extending end panels 13. The end panels 13 are appropriately attached at their intermediate portions to the short ends of the intermediate panel 12 by a mitered joint 14. The panels are preferably made of wood and may be joined together by such means as screws and wood glue.

The knockdown toy further includes two side panels 15. The side panels are of a length approximately equalling the long sides of the intermediate panel 11. The side panels 15 extend to a height substantially equal to the height of the ends panels 13 above its intermediate panel 11.

Each side panel 15 includes two wooden dowel pins 17 which are inserted into appropriate apertures and fixed in place in the lower edge of the side panels 15 as shown in FIG. 1. The outer edge of the intermediate panel 11 includes two apertures 18 (only one shown) which appropriately spaced along the edge of the intermediate panel to correspond with the positioning of the dowel pins 17 in the side panels 15. This arrangement permits the side panels 15 to be detachably secured in place upon the outer edge of the intermediate panel 11 and between the end panels 13 whenever the dowel pins 17 are positioned in the apertures 18 as illustrated in FIG. 1. The cooperative relationship of both side panels with the intermediate panel is identical.

Two end rocker panels 19 are also provided in the knockdown toy of the present invention. The end rocker panels each include a straight bottom edge 20 and an arcuate or curved upper edge 21 as illustrated in FIG. 1. Additionally, the rocker panels are of a length such as to slightly overhang or extend on either end beyond the upper edge of the end panels 13.

Each rocker panel 19 includes two wooden dowel pins 22 which are secured in appropriate apertures positioned in the bottom edge 20 of the rocker panel as shown in FIG. 1. The upper edge of each of the end panels 13 includes two apertures 23 which are spaced such as to correspond and mate with the dowel pins 22 in a manner to permit the rocker panels 19 to be detachably secured to the upper end of the end panels 13 are shown in FIG. 1. Additionally, the lower edge 24 of each of the end panels includes identical apertures 25 spaced such as to receive the dowel pins 22 of the rockers 19 when positioned underneath the end panels 13 as to be discussed hereinafter in respect to FIGS. 5 and 7 of the drawings.

Each rocker panel 19 includes five evenly spaced apertures 26 along the upper edge 21 thereof. Five elongated rod like members 27 (only one partially shown in FIG. 1) are provided with the knockdown toy. In assembled position, the respective ends of each of the five rods may be positioned in the apertures 26 of the rocker panels 19, When the rocker panels are then positioned on top of the end panels 13, a covered wagon or canopy effect is created.

The knockdown toy of the present invention further includes two sets of axle-wheel assemblies. The first assembly 28 represents a rear wheel assembly. This assembly includes a generally rectangular wooden axle member 29 and two wooden wheels 30. The wheels 30 are appropriately secured to the axle 29 by means of screw devices 31 as shown in FIG. 1.

The rear wheel assembly 28 includes two wooden dowel pins 32 pressed or glued into apertures within the axle 29. The dowel pins 32 are identically spaced to the dowel pins 22 of the rocker panel 19. In this manner, the dowel pins 32 will fit into the apertures 25 positioned in the lower end 24 of each of the end plates 13. When in place, the rear wheel assembly 28 becomes the rear wheels of a wagon to be constructed.

The second axle-wheel assembly 33 included in the knockdown toy of the present invention serves as the front wheels of the wagon. This wheel assembly, like the rear wheel assembly, includes a generally rectangular wooden axle number 34 and two wooden wheels 35 likewise secured by a screw device 36 to the ends of the wooden axle number 34.

The front wheel assembly 33 includes a wagon tongue 37 which terminates at a first end in a handle 38. The opposite end of the tongue 37 fits into a relieved section 39 formed into a block member 40 which is appropriately secured by fastening means such as screws (not shown) to the rectangular axle member 34. The opposite end of the tongue 37 includes an aperture therein (not shown). A wooden dowel pin 41 is pressed into an aperture 42 extending horizontally through the block member 40. The dowel pin 41 passes through the aperture in the end of the tongue member 37 and thus secures the tongue member to the block member 40 as shown in FIG. 1.

The front wheel assembly 33 includes a single dowel pin 43 secured to the upper and central portion of the rectangular axle 34. The lower end 24 of each end plate 13 further includes a centrally disposed aperture 45. The dowel pin 43 on the front axle assembly is designed to fit into the aperture 45 on each end plate to appropriately position the front axle assembly and to permit the front axle assembly to be rotated for steering of the assembled wagon.

The lower portion of each end panel 13 includes relieved sections 46 at either end or outer edge thereof. These relieved sections provide the necessary clearance for the wheels 30 and 35 of the front and rear wheel assemblies.

When all of the components of the knockdown toy are assembled into the configuration of FIG. 1, a covered Conestoga wagon results. Other configurations of toys can result by using differing combinations of the basic components shown in FIG. 1 assembled in differing manners. Various of the combinations which may be created are shown in FIGS. 2–7 of the drawings. The manner of assembly of the configurations shown in FIGS. 2–7 of the drawings is accomplished in the same general manner as the Conestoga wagon in FIG. 1. Accordingly, it is not believed necessary to describe the details of assembly necessary to arive at the configurations shown in FIGS. 2–7 and they will thus be briefly described.

Figure 2:
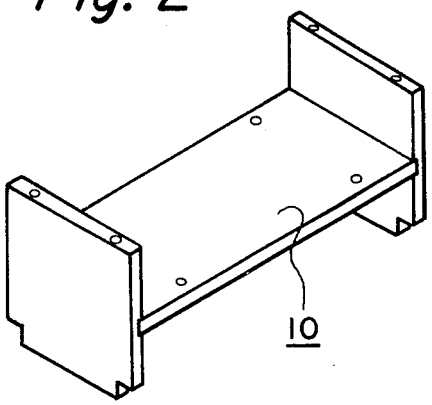
FIGS. 2–7 represent different toy configurations into which the knockdown toy may be assembled as follows.
Figure 3:
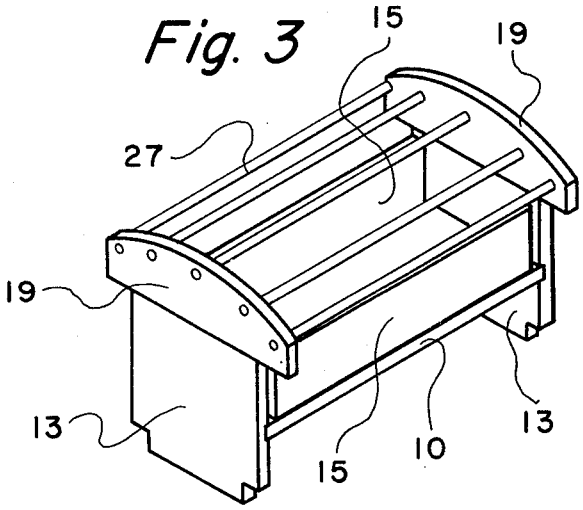

The basic frame member 10 may itself serve as a doll bed as shown in FIG. 2. As shown in FIG. 3, whenever the two rocker panels 19 are assembled in place to the upper edges of the end panels 13 together with the rod like members 27, a doll bed with a canopy results.

Figure 4:
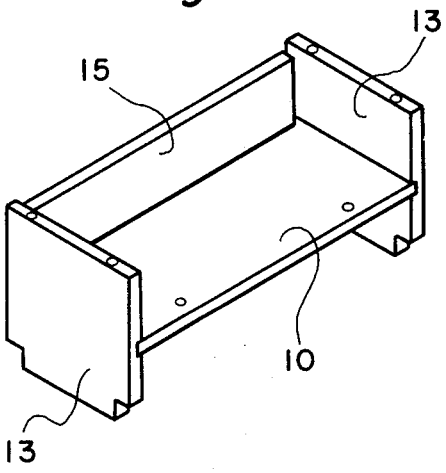
Figure 5:
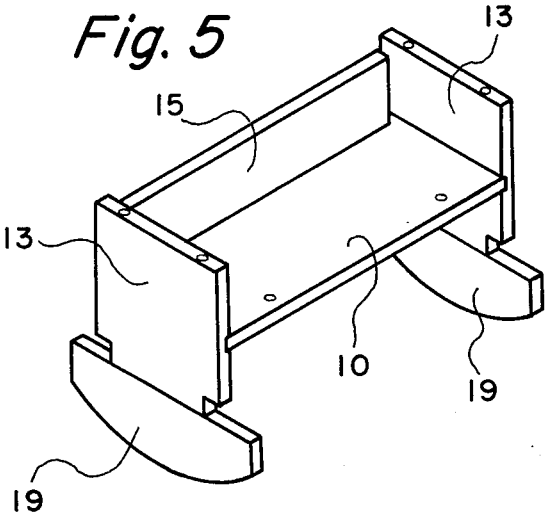

As shown in FIG. 4, utilization of the basic framme 10 with its included end panels 13 assembled together with a single side panel 15 results in a basic doll sofa. Whenever the basic sofa shown in FIG. 4 has added thereto the two rocker panels 19 positioned to the lower edges of the end panels 13, a rocking sofa results.

Figure 6:
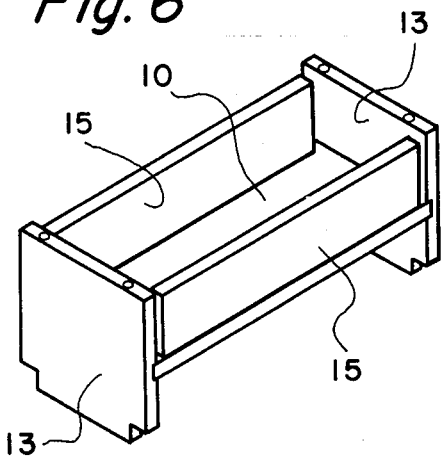
Figure 7:
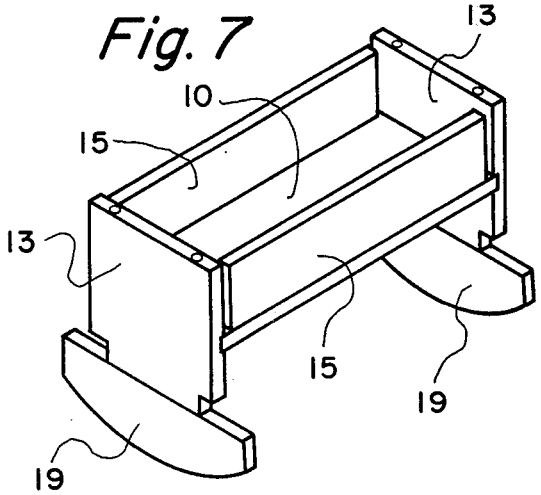

As further shown in FIG. 6, the basic sofa shown in FIG. 4 becomes a bed with sides whenever the two side panels 15 are positioned in place as shown in FIG. 6. Addition of the two rocker panels 19 to the lower edges of the end panels 13, as shown in FIG. 7, results in a rocking cradle.

Various other combinations may be assembled out of the basic components involved in the knockdown toy of the present invention and it is not believed necessary to illustrate all of these. For example, the front and rear wheel assemblies may be utilized with the basic frame as shown in FIG. 2 to provide an open wagon. Likewise, addition of the wheel assemblies to the basic bed shown in FIG. 6 results in a wagon with sides. In other configurations, the canopy bed shown in FIG. 3 could have included thereto the side panels 15 to provide essentially an enclosed cage like toy. The knockdown toy of the present invention is preferably made of wood. However, other material such as plastic could be used.

The knockdown toy of the present invention has been described in the preceding specification in respect to a particular embodiment thereof shown in the drawings. Other modifications and variations of the invention will become apparent to those skilled in the art in view of the preceding disclosure. No limitation as to the scope of the invention was intended by the description of the invention taken in conjunction with the particular embodiment described but the scope of the invention is to be interpreted in view of the claims.

I claim:

1. A knockdown toy capable of being converted into a plurality of different toy configurations of beds, sofas and cradles comprising:

a basic frame formed of a flat horizontally disposed rectangular intermediate panel having one pair of sides longer than the other and complementary opposed end panels secured at approximately their mid points to the short sides thereof intermediate the end panels and perpendicular thereto;

two side panels of length approximating the long sides of the intermediate panel and of height approximating the distance the end panels project above the intermediate panel;

means for releasably securing each side panel to the long sides of the intermediate panel;

two end rocker panels each including an arcuate edge; and means for releasably securing each rocker panel to either the upper or lower extremity of each end panel whereby selective assembly of the different components will create different toys.

2. The toy of claim 1 further including a plurality of elongate rod like members and a plurality of apertures within each rocker panel adapted to secure the respective ends of the rod like members and a plurality of apertures within each rocker panel adapted to secure the respective ends of the rod like members whereby a canopy like effect is created when the rocker panels are in place on the upper extremity of the side panels and the rod like members assembled to the rocker panels.

3. The knockdown toy of claim 1 further including two axle and wheel assemblies and means for securing the axle and wheel assemblies to the lower extremity of each of the side panels whereby a wagon configuration can be assembled.

* * * * *